US009281563B2

(12) United States Patent
Matsunaga et al.

(10) Patent No.: US 9,281,563 B2
(45) Date of Patent: Mar. 8, 2016

(54) ANTENNA

(75) Inventors: Mayumi Matsunaga, Ehime (JP); Kenji Kakemizu, Ehime (JP)

(73) Assignee: NATIONAL UNIVERSITY CORPORATION EHIME UNIVERSITY, Ehime (JP)

( * ) Notice: Subject to any disclaimer, the term of this patent is extended or adjusted under 35 U.S.C. 154(b) by 323 days.

(21) Appl. No.: 13/820,336

(22) PCT Filed: Aug. 26, 2011

(86) PCT No.: PCT/JP2011/069244

§ 371 (c)(1),
(2), (4) Date: Mar. 1, 2013

(87) PCT Pub. No.: WO2012/029639

PCT Pub. Date: Mar. 8, 2012

(65) Prior Publication Data

US 2013/0176187 A1 Jul. 11, 2013

(30) Foreign Application Priority Data

Sep. 1, 2010 (JP) ..... 2010-196260

(51) Int. Cl.

| | |
|---|---|
| ***H01Q 9/16*** | (2006.01) |
| ***H01Q 7/00*** | (2006.01) |
| ***H01Q 1/24*** | (2006.01) |
| ***H01Q 1/38*** | (2006.01) |
| ***H01Q 9/27*** | (2006.01) |

(52) U.S. Cl.

CPC ..... *H01Q 7/00* (2013.01); *H01Q 1/243* (2013.01); *H01Q 1/38* (2013.01); *H01Q 9/16* (2013.01); *H01Q 9/27* (2013.01)

(58) Field of Classification Search

None

See application file for complete search history.

(56) References Cited

U.S. PATENT DOCUMENTS

| | | | | |
|---|---|---|---|---|
| 5,168,230 | A * | 12/1992 | Hashoian et al. | 324/318 |
| 6,130,651 | A | 10/2000 | Yanagisawa et al. | |
| 2010/0164820 | A1 * | 7/2010 | Matsunaga et al. | 343/729 |

FOREIGN PATENT DOCUMENTS

| | | |
|---|---|---|
| JP | 11-317612 | 11/1999 |
| JP | 2000-269724 | 9/2000 |
| JP | 2004-40596 | 2/2004 |
| JP | 2009-10909 | 1/2009 |
| JP | 2009-207005 | 9/2009 |
| WO | WO 2008146430 A1 * | 12/2008 |

OTHER PUBLICATIONS

International Search Report issued Oct. 25, 2011 in International (PCT) Application No. PCT/JP2011/069244.

Kenji Kakemizu, Mayumi Matsunaga, Toshiaki Matsunaga, "*A Multi-Polarization and Multi-Frequency Antenna*", IEICE Technical Report, vol. 110, No. 197, The Institute of Electronics, Information and Communication Engineers, Sep. 2, 2010, pp. 19 to 22.

Matsunaga, M.; Kakemizu, K.; Candotti, M.; Matsunaga, T.; "*A Multi-polarization and multi-frequency single layer planar antenna*", Antennas and Propagation (EUCAP), Proceedings of the 5th European Conference on Apr. 15, 2011, pp. 623-626.

* cited by examiner

*Primary Examiner* — Graham Smith

(74) *Attorney, Agent, or Firm* — Wenderoth, Lind & Ponack, L.L.P.

(57) ABSTRACT

A shared antenna communicates radio waves with different frequencies or different polarization characteristics, and has a simple configuration that can be placed in a small device. The antenna includes a plurality of loops of the shape of a cross in a spiral fashion and includes a gap provided at a certain midpoint in the spiral loops and a power supply portion provided in a central portion. The distance of the gap is set such that electromagnetic coupling is caused at a first frequency and no electromagnetic coupling is caused at a second frequency different from the first frequency.

7 Claims, 9 Drawing Sheets

ANTENNA

TECHNICAL FIELD

The present invention relates to an antenna having the function of communication with a plurality of communication schemes for transmitting or receiving radio waves.

BACKGROUND ART

Mobile communication devices such as cellular phones and car navigation systems are widely used. Each of those devices has a specific frequency and a specific polarization mode. For example, the GPS (Global Positioning System) such as a car navigation system employs circularly polarized radio waves. By way of example, PTL 1 has described an antenna which has a small size but has favorable characteristics of circularly polarized waves.

In recent years, the mobile communication devices have more and more functions. For example, cellular phones having the GPS function are becoming popular. Such mobile communication devices having numerous functions need to transmit and receive a plurality of radio waves having different frequencies or polarized differently. To satisfy the requirement, a plurality of antennas are mounted to individually support the types of radio waves to be used.

Each of PTL 2 and PTL 3 has proposed a shared antenna which can transmit and receive a plurality of radio waves having different frequencies and polarized differently.

CITATION LIST

Patent Literature

[PTL 1] JP-A-2009-10909
[PTL 2] JP-A-2010-68473
[PTL 3] JP-A-2008-278059

SUMMARY OF THE INVENTION

While the antenna described in PTL 1 has the small and simple configuration but has the favorable characteristics of circularly polarized waves, PTL 1 has made no description of an antenna for communicating linearly polarized waves. Since cellular phones having the GPS function have an antenna for linearly polarized waves and an antenna for circularly polarized waves mounted thereon, the antenna has an increased size accordingly and requires difficulty with layout in view of incorporation into the small device. In addition, the closely placed antennas having the different characteristics cause interference with each other to reduce the performance.

To address these disadvantages, a shared antenna capable of transmitting and receiving radio waves having different characteristics is desired. For example, the antenna described in PTL 2 is a film antenna provided by placing a conductor on an insulating film and operates as an antenna for circularly polarized waves and an antenna for linearly polarized waves. PTL 2, however, assumes the use at extremely high frequencies including a first operational frequency of 2.6 GHz and a second operational frequency of 5.8 GHz, if the frequencies are set at 1.5 GHz for the linearly polarized waves and 2.6 GHz for the circularly polarized waves, the size is too large to be mounted on a small device such as a cellular phone terminal. The antenna described in PTL 3 has an element for linearly polarized waves and an element for circularly polarized waves that are placed closely, and this basically corresponds to the mounting of a plurality of antennas. The antenna inevitably has the complicated configuration and is costly. In addition, the antenna has the structure including two or more layers to result in a large thickness, so that it is difficult to incorporate the antenna into a small device.

In addition to the above examples, a shared antenna has been proposed in which a switch is provided in a circuit to make switching between ON and OFF. The antenna also leads to a complicated and costly device and needs a dedicated communication circuit for control of the switch. In addition, since the antenna is used with the switching by the switch, the linearly polarized waves and the circularly polarized waves can not be used at the same time. Another proposed antenna includes a Ni-plated layer and an Au-plated layer on a metallized layer such as a Cu layer and an Mo—Mn layer. The antenna is also costly.

It is an object of the present invention to provide a shared antenna capable of communicating radio waves with different frequencies or different polarization characteristics, having a simple configuration, and capable of being placed in a small device.

To solve the foregoing problems, an antenna according to the invention includes a first antenna portion having a plurality of loops of the shape of a cross in a spiral fashion, a second antenna portion adjacent to the first antenna portion with a cutting portion interposed therebetween, and a power supply portion provided in a central portion, electromagnetic coupling being caused in the cutting portion at a first frequency, and no electromagnetic coupling being caused at a second frequency different from the first frequency.

The second antenna portion may have a plurality of loops of the shape of a cross in a spiral fashion, the second antenna portion may be provided on the outer circumference of the first antenna portion, the cutting portion may be a gap between an outer end portion of the first antenna portion and an inner end portion of the second antenna portion, the power supply portion may be provided in the central portion of the spiral loops of the first antenna portion, and the distance of the gap may be set such that electromagnetic coupling is caused at the first frequency and no electromagnetic coupling is caused at the second frequency higher than the first frequency. An electric current flowing a portion along a first direction in the loops of the cross shape and an electric current flowing a portion along a second direction perpendicular to the first direction may have substantially the same phase at the first frequency and may substantially have a phase difference of $\pi/2$ at the second frequency.

The second antenna portion may be a dipole antenna provided inside the first antenna portion, electromagnetic coupling may be caused in the cutting portion at the first frequency, and no electromagnetic coupling may be caused in the cutting portion at the second frequency higher than the first frequency. Alternatively, the second antenna portion may be a loop antenna provided outside the first antenna portion, electromagnetic coupling may be caused in the cutting portion at the first frequency, and no electromagnetic coupling may be caused in the cutting portion at the second frequency higher than the first frequency.

The invention can realize the small shared antenna capable of communicating a plurality of radio waves having different frequencies or polarized differently. The invention can realize the planar antenna having a simple configuration with a single layer and a single power supply portion (one port).

DETAILED DESCRIPTION OF INVENTION

The best mode for carrying oat the invention will foe described. An antenna according to the invention has a first antenna portion having a plurality of loops of the shape of a cross in a spiral fashion, a second antenna portion adjacent to the first antenna portion with a cutting portion interposed therebetween, and a power supply portion provided in the center. The antenna provides electromagnetic coupling in the cutting portion at a first frequency and provides no electromagnetic coupling at a second frequency different from the first frequency.

Figure 1:
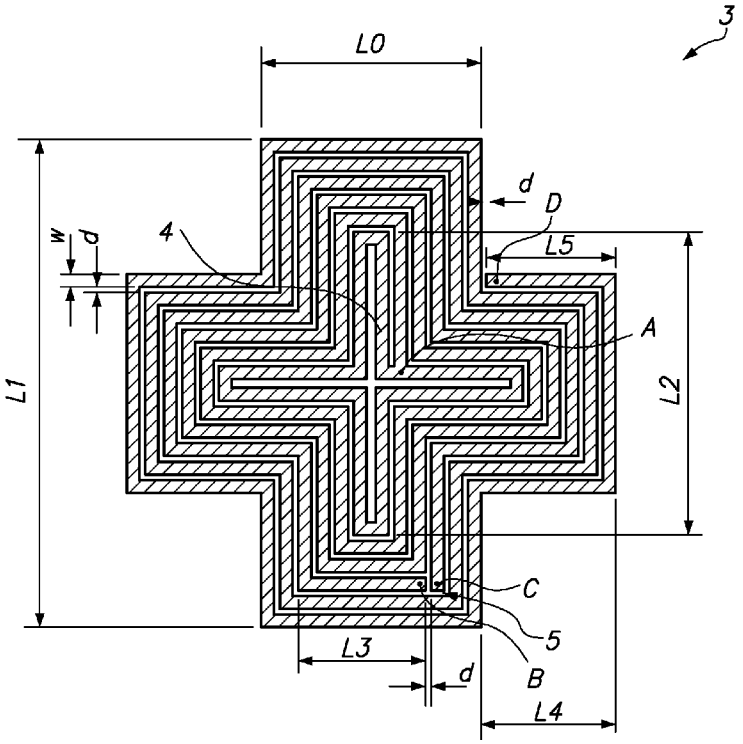
FIG. 1 is a plan view showing the basic structure of an antenna.
Figure 2:
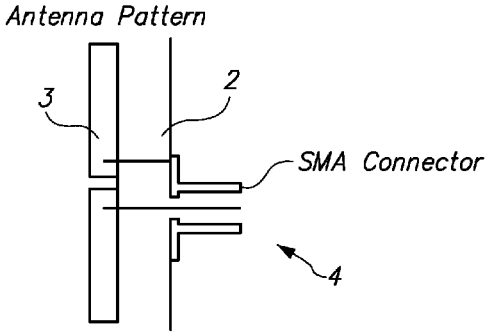
FIG. 2 is an enlarged side view showing the details of a power supply portion.
Figure 3:
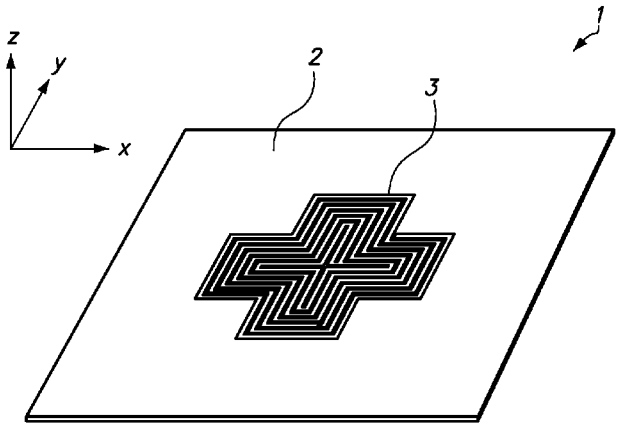
FIG. 3 is a perspective view showing the overview of the antenna.

The detailed description will hereinafter be made with reference to the accompanying drawings. FIG. 1 is a plan view showing the basic structure of the antenna. FIG. 2 is an enlarged side view showing the details of the power supply portion, and FIG. 3 is a perspective view showing the overview of the antenna.

The antenna 1 is a planar antenna provided by placing a spiral conductor line 3 of the cross shape on a dielectric substrate 2. The planar antenna means that it does not need to have a three-dimensional structure such as a multilayer structure and a parabolic shape. Thus, when a communication device has a slightly curved outer surface, the antenna may be formed along the outer surface. A thin and flexible film may be used to form the substrate to provide a deformable antenna.

The conductor line 3 has a cross outer shape. Specifically, the shape corresponds to two rectangles with a shorter side of L0 and a longer side of L1 placed one on the other such that the barycenters of the rectangles are matched and the rectangles are shifted from each other by 90 degrees. The central portion is a square having one side of L0, and a rectangle having a width of L0 and a length of L4 (=(L1−L0)/2) extends from each of the sides of the square.

An end portion D of the outermost loop is provided near one of the corners of the square in the central portion of the cross shape. The end portion D is opened. The conductor line of the outermost loop is formed with a line width of w from the point D as a starting point. The line loops along the cross outer shape and forms the next loop from near the starting point D. The next loop is formed inside the first loop at a distance d therefrom. The loop is similarly repeated in a spiral fashion to near the central portion as much as possible.

The length L1 of the cross shape of the outermost loop and a length L2 of the cross shape of the innermost loop are selected on the basis of the frequency to be used as a reference. When two frequencies are used, the outermost length L1 is adapted to a first frequency, and the innermost length L2 is adapted to a higher second frequency. While the length is calculated on the basis of a quarter of the wavelength, the influence of the dielectric constant of the substrate is included as a factor. The power supply portion 4 is provided in the innermost loop line. While the power supply portion is placed near the center of the cross shape, it may not be located exactly at the center but may be placed at a position slightly shifted from the center in view of ease of attachment of a connector or the like.

A gap 5 is provided at a certain midpoint in the spiral conductor line. The distance of the gap 5 is selected on the basis of the frequency of radio waves to be used. Specifically, the distance is set such that the conductor line before and after the gap causes electromagnetic coupling, that is, interference, at the first frequency, and causes no interference at the second frequency. In the example of FIG. 1, the first antenna portion is formed of the spirals outside the gap 5, and the second antenna portion is formed of the spirals inside the gap 5.

A transmission circuit and a communication circuit connected to the antenna are not limited particularly. Conventional circuits can be used as a communication circuit for the first frequency and a communication circuit for the second frequency and can be connected without any changes to the power supply portion. The antenna serves as a shared antenna for communication of linearly polarized waves at the first frequency and circularly polarized waves at the second frequency.

Example 1

Next, the invention is described in more detail with reference to First Example. This example is an example of a shared antenna for communication of linearly polarized waves at 1.5 GHz and circularly polarized waves at 2.45 GHz. Epoxy resin was used for the substrate 2. The epoxy resin has nominal properties including a thickness of 1 mm, a relative permittivity of 4.3, and a dielectric tangent of 0.018. On the substrate 2, a line made of copper (with a conductivity of $5.8\times10^7$ S/m) was formed with a thickness of 0.035 m and a width of 1 mm.

The conductor line 3 has the following dimensions: L1=39.0 mm; L0=17.5 mm; L2=24.0 mm; L3=10.0 mm; L4=10.75 mm; L5=10.25 mm; w=1 mm; and d=0.5 mm. The conductor line has a spiral form having six loops of the cross shape.

The conductor line has a cutting of 0.125 mm formed at the power supply portion 4, and an SMA connector is provided therein. A terminal of the connector is connected near each end portion of the conductor line cut at the cutting.

The gap 5 is provided at one corner on the third loop from the outside. The gap 4 has a width of 0.5 mm.

Transmitting/receiving circuits are connected to the connector in the power supply portion 4 to perform transmission and reception by the antenna 1. Since the supply portion to the antenna is formed of one port, the connection of the circuit is easily achieved and the communication device is simply configured.

Based on the antenna in this example, the characteristics thereof were determined through simulations and actual measurements. The simulations were performed with Sonnet Suites (product name) which is a simulation program for electromagnetic wave characteristics.

Figures 4A, 4B:
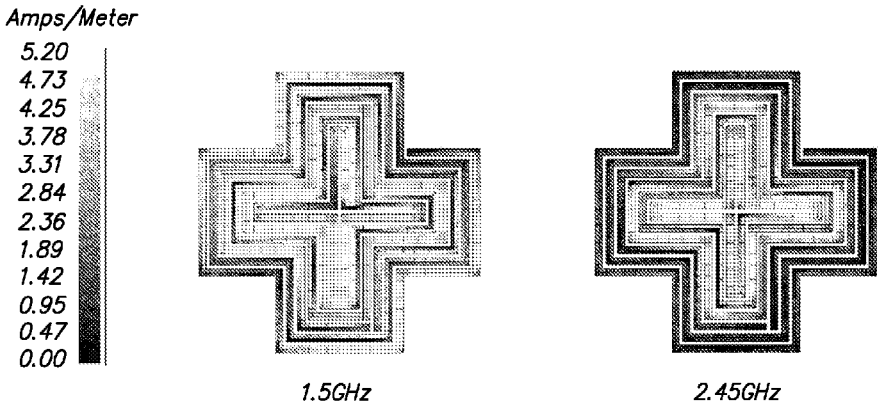
FIG. 4 is a plan view showing the distributions of electric current in the antenna.

FIG. 4 shows the distributions of electric current on the conductor line. Portions shown in white color represent a larger current. It can be seen that the current distributions are different at the first frequency (1.5 GHz) and the second frequency (2.45 GHz). At the first frequency, the current is distributed over the entire conductor line 3. At the second frequency, the current distribution is found only in inner portions.

The current flowing in the portion along a first direction (x axis direction) and the current flowing in the portion along a second direction (y axis direction) perpendicular to the first direction have substantially the same phase at the first frequency in the loops constituting the cross shape. Thus, the antenna has linear polarization characteristics. On the other hand, at the second frequency, the currents substantially have a phase difference of $\pi/2$, and the antenna has circular polarization characteristics.

Figure 5:
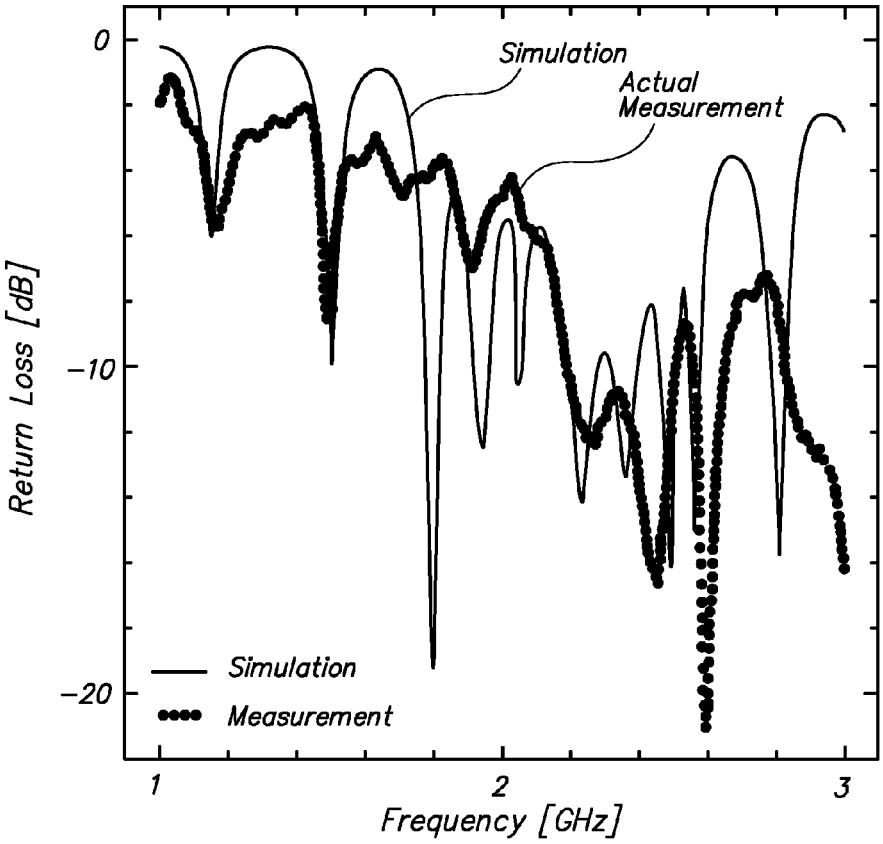
FIG. 5 is a graph illustrating the return loss characteristics of the antenna.

FIG. 5 is a graph showing the return loss characteristics of the antenna. The vertical axis represents the values of the return loss characteristics in dB. It is assumed that the transmission/reception performance is high when the curve falls on the graph. Both the curve representing simulation values and the curve representing actual measurement values fall at 1.5 GHz and 2.45 GHz, and low numerical values are also found at other frequencies. Those facts can suggest that the antenna can perform transmission and reception at two or more frequencies. While the simulation values and the actual measurement values are well matched, slight differences are seen possibly due to the manner of attachment of the connector.

Figure 6A:
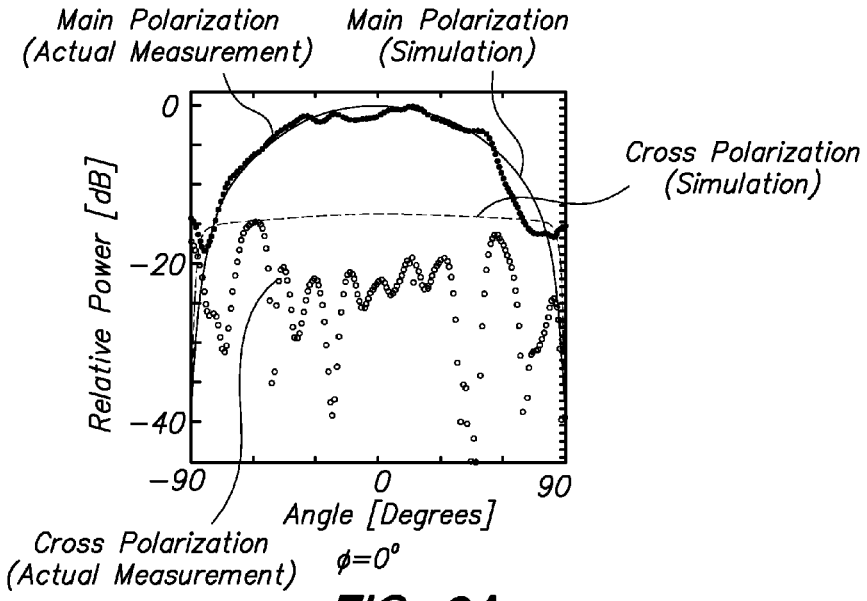
FIG. 6 is a graph illustrating the linear polarization characteristics of the antenna at a first frequency.
Figure 6B:
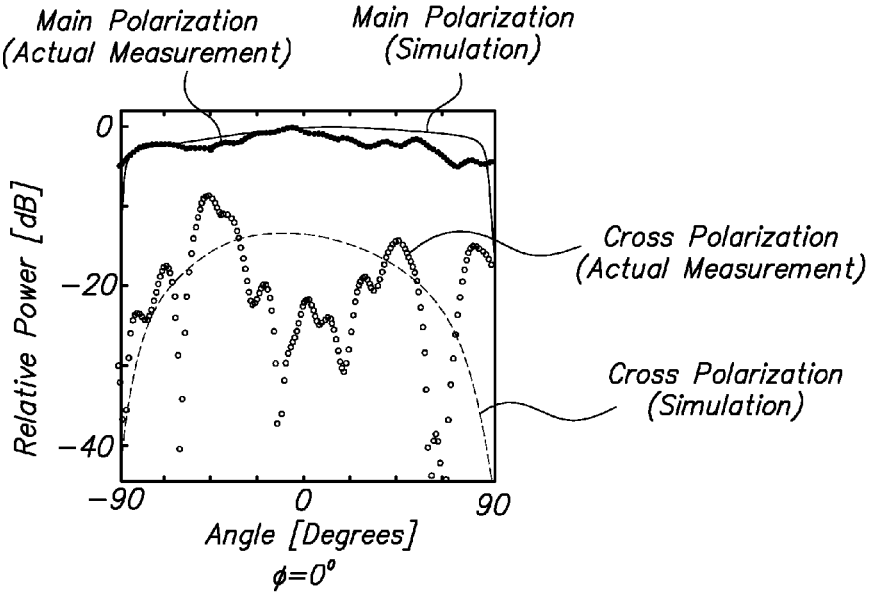

FIG. 6 shows graphs representing the linear polarization characteristics of the antenna 1 at the first frequency. FIG. 6(*a*) and FIG. 6(*b*) show radiation characteristics on a plane with $\Phi=0°$ and a plane with $\Phi=90°$, respectively. When the characteristics are shown on polar coordinates with the center set at the central position of the antenna shown in FIG. 2, the plane (x-y plane) of the antenna is assumed to be the plane of an azimuth angle, and the x axis and the y axis are assumed to be $\Phi=0°$ and $\Phi=90°$ respectively. An elevation angle $\theta$ is assumed to be 0° ($\theta=0°$) along the z axis. The horizontal axis in FIG. 6 represents the elevation angle $\theta$. At angles $\theta$ ranging from 45° to −50° on the plane with $\Phi=0°$ and at all angles on the plane with $\Phi=90°$, main polarization and cross polarization can be separate by 10 dB or more, which indicates that the linear polarization characteristics can be provided at 1.5 GHz. The simulation values and the actual measurement values are well matched.

Figure 7A:
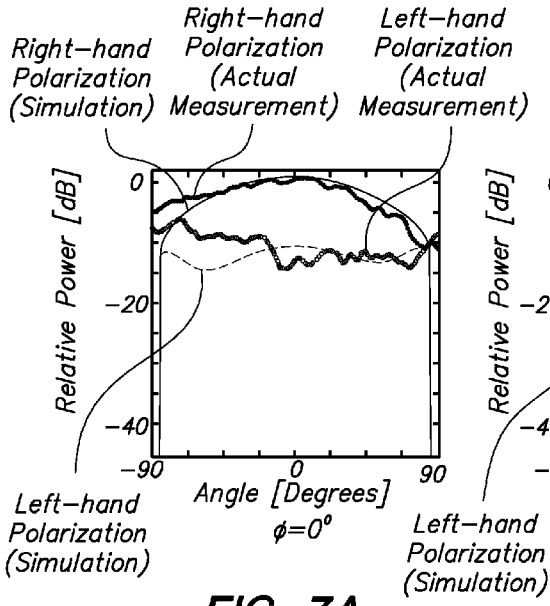
FIG. 7 is a graph illustrating the circular polarization characteristics of the antenna at a second frequency.
Figure 7B:
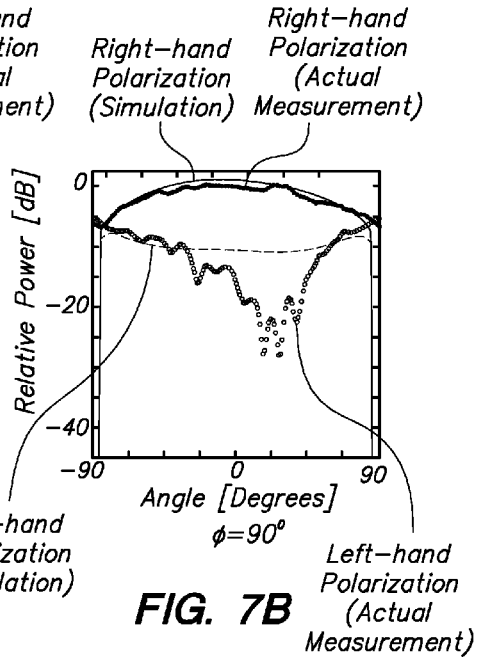

FIG. 7 shows graphs representing the circular polarization characteristics of the antenna 1 at the second frequency. FIG. 7(*a*) and FIG. 7(*b*) show radiation characteristics at 2.45 GHz on a plane with $\Phi=0°$ and a plane with $\Phi=90°$, respectively. It can be seen from those graphs that, at angles $\theta$ ranging from +55° to −60° on the plane with $\Phi=0°$ and at angles $\theta$ ranging from +35° to −35° on the plane with $\Phi=90°$, right-hand polarized components and left-hand polarized components can be separate by 10 dB or more, which indicates that the circular polarization characteristics can be provided at 2.45 GHz.

Figure 8:
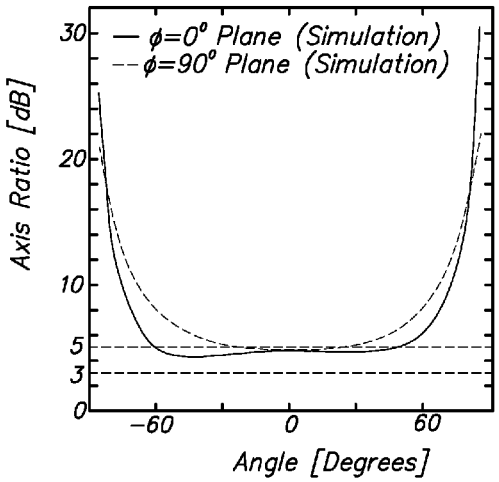
FIG. 8 is a graph illustrating the axis ratio of the antenna at the second frequency.

FIG. 8 is a graph showing an axis ratio determined from the circularly polarization characteristics of the antenna at 2.45 GHz. The beam width at an axis ratio of 5 dB or lower is 100° from +45° to −55° on the plane with $\Phi=0°$ and is 45° from +25° to −20° on the plane with $\Phi=90°$. Particularly, on the plane with $\Phi=0°$, the flat axis ratio can be achieved over the wide angular range. It can thus be seen that the favorable circular polarization characteristics are realized.

Example 2

Figure 9:
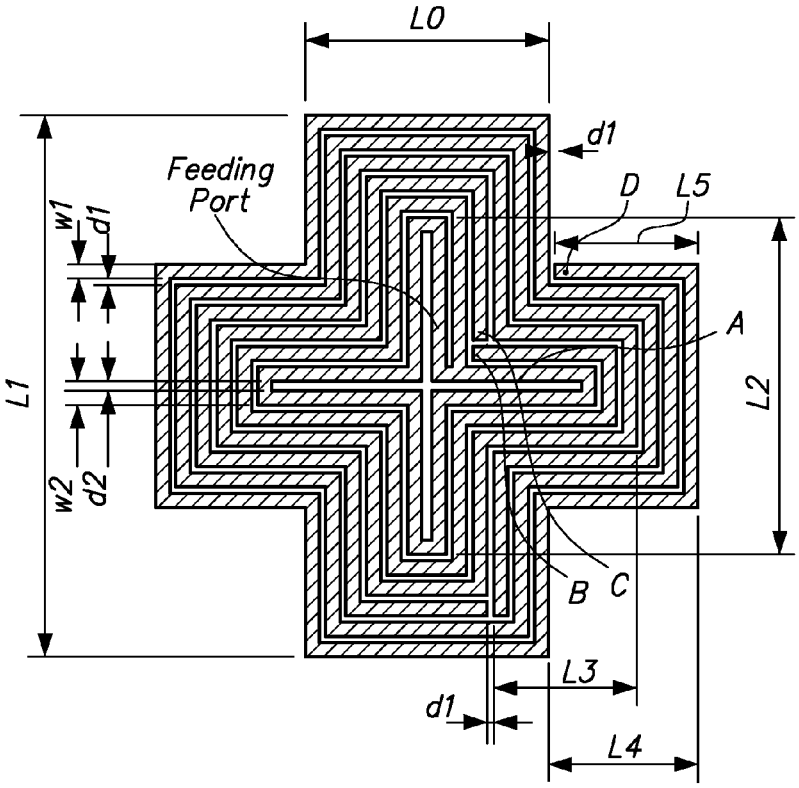
FIG. 9 is a plan view showing the basic structure of an antenna of Example 2.

Second Example of the invention will be described. FIG. 9 is a plan view showing the basic structure of an antenna according to Example 2. Example 2 is an example of a shared antenna for communicating linearly polarized waves at 1.74 GHz and circularly polarized waves at 1.58 GHz. The linearly polarized waves at 1.74 GHz can be used for cellular phones based on the W-CDMA standard, and the circularly polarized waves at 1.58 GHz can foe used for the GPS. The substrate is made of epoxy resin, and its properties include a thickness of 1 mm, a relative permittivity of 4.3, and a dielectric tangent of 0.018. A line made of copper (with a conductivity of $5.8\times10^7$ S/m) was formed with a thickness of 0.035 mm on the substrate.

The conductor line has the following dimensions: L1=51.0 mm; L0=19 mm; L2=38.2 mm; L3=15.4 mm; L4=16 mm; and L5=15 mm. The conductor line has a width w1 of 1 mm and a distance d1 of 0.6 mm. On the innermost loop, the conductor line has a width w2 of 2.6 mm and a distance d2 of 1 mm. The conductor line has four loops with a width of 1 mm and an inner single loop with a width of 2.6 mm. The conductor line has a spiral form having five loops of the shape of a cross. Simulations similar to those in Example 1 were performed on the antenna.

Figure 10:
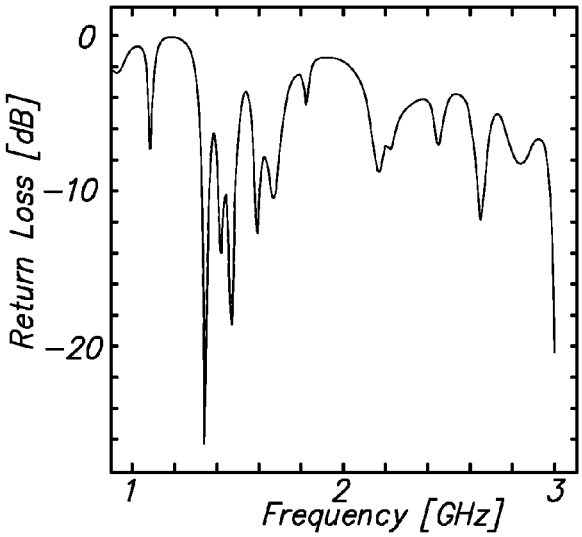
FIG. 10 is a graph illustrating the return loss characteristics of the antenna of Example 2 provided by simulations.

FIG. 10 is a graph showing the return loss characteristics of the antenna of Example 2. In the graph, a curve falls at 1.58 GHz and 1.74 GHz, and low numerical values are also found at other frequencies. Those facts can suggest that the antenna can perform transmission and reception at two or more frequencies.

Figure 11A:
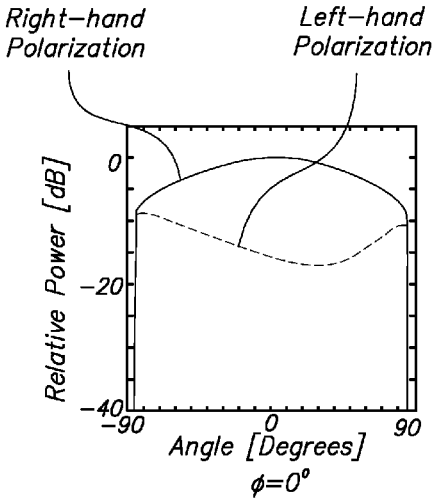
FIG. 11 is a graph illustrating the circular polarization characteristics of the antenna of Example 2 at 1.58 GHz.
Figure 11B:
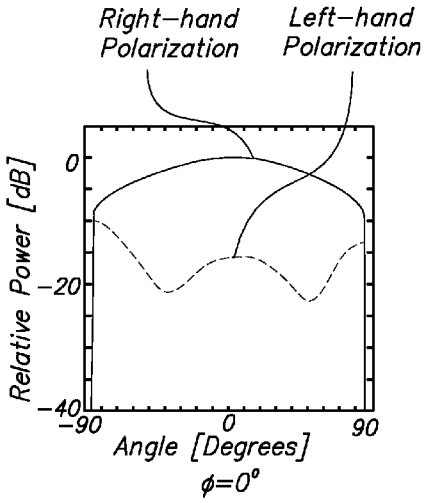

FIG. 11 shows graphs representing the circular polarization characteristics of the antenna at the frequency of 1.58 GHz. FIG. 11 (*a*) and FIG. 11(*b*) show radiation characteristics on a plane with $\Phi=0°$ and a plane with $\Phi=90°$, respectively. It can be seen from those graphs that right-hand components and left-hand components can be separate sufficiently, which indicates that the circular polarization characteristics can be provided.

Figure 12A:
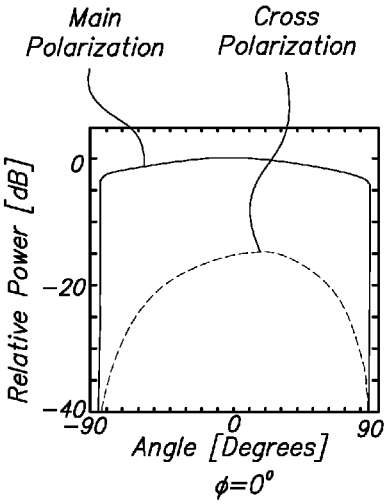
FIG. 12 is a graph illustrating the linear polarization characteristics of the antenna of Example 2 at 1.74 GHz.
Figure 12B:
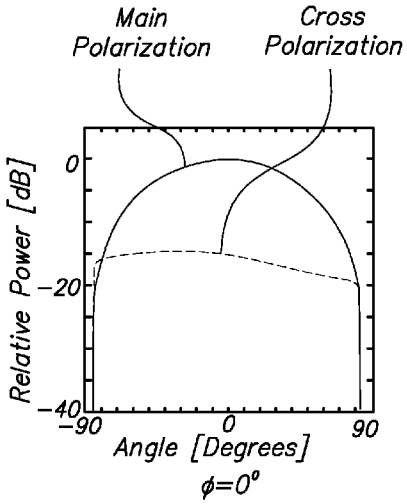

FIG. 12 shows graphs representing the linear polarization characteristics of the antenna at the frequency 1.74 GHz. FIG. 12(*a*) and FIG. 12(*b*) show radiation characteristics on the plane with $\Phi=0°$ and the plane with $\Phi=90°$, respectively. Main polarization and cross polarization can be separate sufficiently, which indicates that the linear polarization characteristics can be provided at the frequency of 1.74 GHz.

Figure 13A:
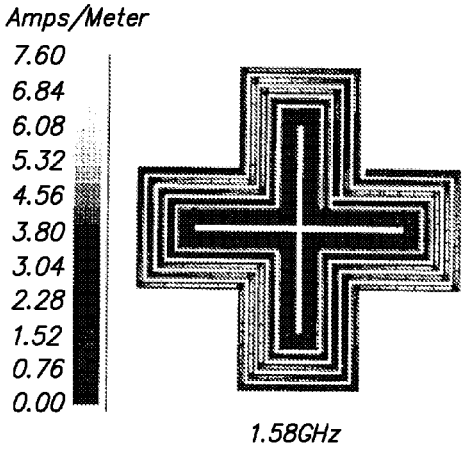
FIG. 13 is a plan view showing the distributions of electric current in the antenna of Example 2.
Figure 13B:
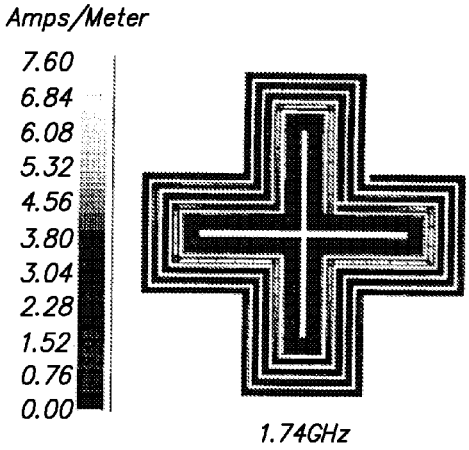

FIG. 13 shows the distributions of electric current on the conductor line. It can be seen that the current distributions are different at the first frequency (1.58 GHz) and the second frequency (1.74 GHz). At the first frequency, the current is distributed over the entire conductor line. At the second frequency, the current distribution is found only in inner portions.

The current flowing in the portion along the first direction (x axis direction) and the current flowing in the portion along the second direction (y axis direction) perpendicular to the first direction substantially have a phase difference of π/2 at the first frequency in the loops constituting the cross shape. Thus, the antenna has circular polarization characteristics. On the other hand, at the second frequency, the currents have substantially the same phase and the antenna has linear polarization characteristics.

Example 3

Third Example according to the invention will be described. This Example is an example in which a thin film having a thickness of 0.5 mm was used as the substrate. The substrate has properties including a relative permittivity of 4.3 and a dielectric tangent of 0.018. A line as shown in FIG. 1 was formed on the substrate.

The conductor line 3 may have the same dimensions as those in Example 1, and in this case, the operational frequency is approximately 1.06 times higher. Thus, in Example 3, the dimensions of L1, L2, L4, and L5 were set to be approximately 1.06 times higher to provide the equivalent antenna. The dimensions are as follows: L0=17.5 mm; L1=41 mm; L2=26 mm; L3=10 mm; L4=11.75 mm; L5=11.25 mm; w=1 mm; and d=0.5 mm. Simulations of the return loss characteristics were performed on the antenna.

Figure 14:
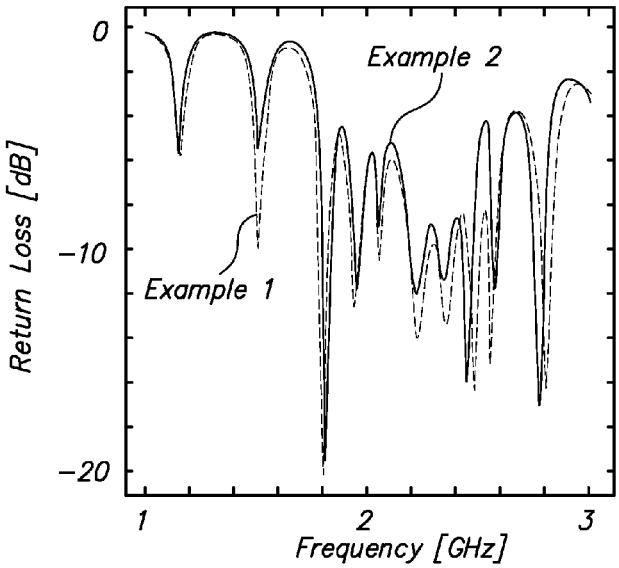
FIG. 14 is a graph illustrating the return loss characteristics of an antenna of Example 3 provided by simulations.

FIG. 14 is a graph showing the return loss characteristics of the antenna in Example 3 provided by the simulations. FIG. 14 also shows the characteristics of Example 1 in dotted lines. Data in Example 1 and data in Example 3 are substantially matched to indicate that they have substantially the same return loss characteristics.

Example 4

Figure 15:
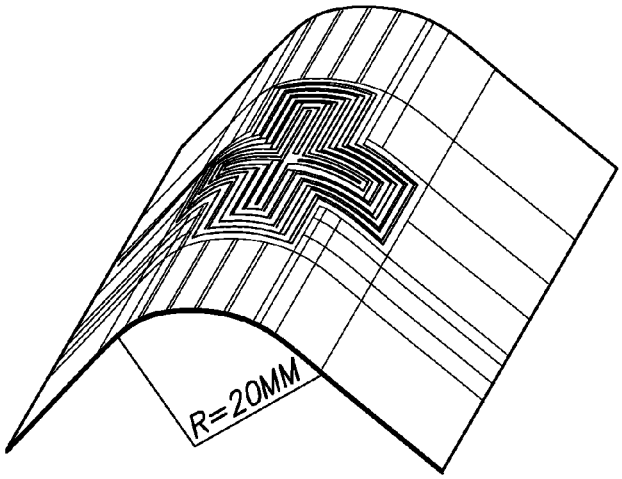
FIG. 15 is a perspective view showing an antenna of Example 4.

Fourth Example according to the invention will be described. FIG. 15 is a perspective view showing an antenna of this Example. This is an example in which the antenna is formed on a film similarly to Example 3 and is curved. Specifically, the conductor line having the same dimensions as those in Example 3 was placed on the film having a thickness of 0.5 mm to form the antenna similarly to Example 3, and the antenna was curved with a radius of curvature of 20 mm.

Figure 16:
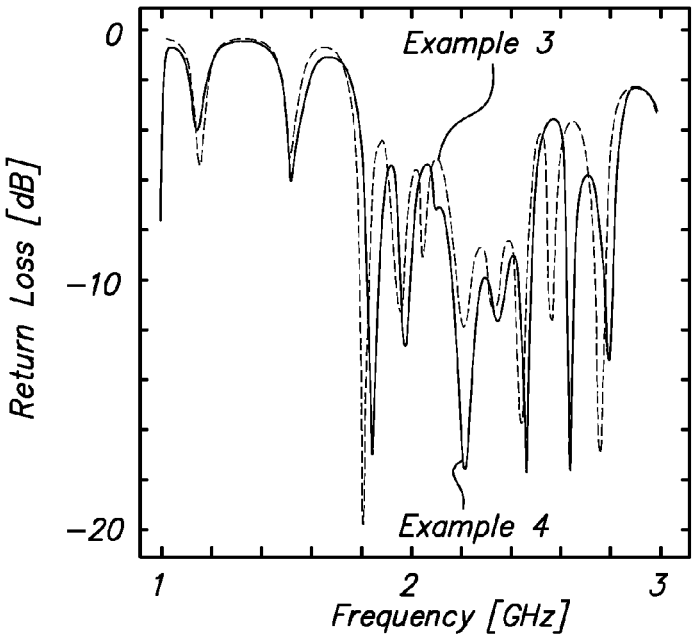
FIG. 16 is a graph illustrating the return loss characteristics of the antenna of Example 4 provided by simulations.

FIG. 16 is a graph showing the return loss characteristics of the antenna in Example 4 provided by simulations. FIG. 16 also shows the characteristics of Example 3 in dotted lines. It can be seen that the antenna in Example 4 and the antenna in Example 3 have substantially the same return loss characteristics at the first frequency and the second frequency. The antenna of this Example can be formed on the thin film to be flexibly deformable, and the communication performance is not reduced when it is deformed.

REFERENCE SINGS LIST

1. ANTENNA
2. SUBSTRATE
3. CONDUCTOR LINE
4. POWER SUPPLY FOIST
5. GAP

The invention claimed is:

1. An antenna comprising:

a first antenna portion having a plurality of loops in a spiral fashion and forming a cross shape;

a second antenna having a plurality of loops in a spiral fashion and forming a cross shape, the second antenna portion being provided on an outer circumference of the first antenna portion such that the first antenna portion comprises an inner portion of the antenna and the second antenna comprises an outer portion of the antenna, the first and second antenna portions being disposed in a same layer; and a power supply provided on an inner most loop of the first antenna portion and at a central location of the antenna, wherein an outer end portion of the second antenna portion is an open end and an outer end portion of the first antenna portion and an inner end portion of the second antenna portion are separated by a gap interposed therebetween, electromagnetic coupling being caused in the gap at a first frequency, and no electromagnetic coupling being caused at a second frequency different from the first frequency.

2. The antenna according to claim 1, wherein the distance of the gap is set such that electromagnetic coupling is caused at the first frequency and no electromagnetic coupling is caused at the second frequency higher than the first frequency.

3. The antenna according to claim 2, wherein an electric current flowing in a portion along a first direction in the loops of the cross shape and an electric current flowing in a portion along a second direction perpendicular to the first direction have substantially the same phase at the first frequency and substantially have a phase difference of π/2 at the second frequency.

4. The antenna according to claim 1, wherein electromagnetic coupling is caused in the gap at the first frequency, and no electromagnetic coupling is caused in the gap at the second frequency higher than the first frequency.

5. An antenna comprising:

a first antenna portion having a plurality of loops in a spiral fashion and forming a cross shape;

a second antenna portion which is a dipole antenna provided adjacent to the inside of the first antenna portion such that the second antenna portion comprises an inner portion of the antenna and the first antenna comprises an outer portion of the antenna, the first and second antenna portions disposed in a single layer with a gap interposed therebetween; and a power supply portion provided in a central portion of the antenna, wherein an outer end portion of the first antenna portion on an outermost loop side is an open end; and electromagnetic coupling is caused between the first antenna portion and the second antenna portion in the gap at the first frequency, and no electromagnetic coupling is caused in the gap at the second frequency different from the first frequency.

6. An antenna comprising:

a first antenna portion having a plurality of loops of a shape of a cross in a spiral fashion connected to an inner most loop of the shape of the cross;

a second antenna portion having a plurality of loops of a shape of a cross in a spiral fashion which is adjacent to the first antenna portion with a gap interposed therebetween and provided on an outer circumference of the first antenna portion in a single layer; and a power supply portion provided in a central portion of the antenna, wherein an end portion of the second antenna portion on an outermost loop side is in an opened state, a distance of the gap is set such that electromagnetic coupling is caused between the first antenna portion and the second antenna portion in the gap at the first frequency and no electromagnetic coupling is caused at the second frequency different from the first frequency, and an electric current flowing in a portion along a first direction in the loops of the cross shape and an electric current flowing in a portion along a second direction perpendicular to the first direction have substantially the same phase at the first frequency and substantially have a phase difference of $\pi/2$ at the second frequency.

7. An antenna comprising:

a first antenna portion having a plurality of loops of a shape of a cross in a spiral fashion;

a second antenna portion which is a dipole antenna provided adjacent to the inside of the first antenna portion in a single layer with a gap portion interposed therebetween; and a power supply portion provided in a central portion of the antenna, wherein an end portion of the first antenna portion on an outermost loop side is in an opened state; and electromagnetic coupling is caused between the first antenna portion and the second antenna portion in the gap portion at the first frequency, and no electromagnetic coupling is caused in the cutting portion at the second frequency different from the first frequency.

* * * * *